United States Patent [19]

Mattes et al.

[11] 4,450,222

[45] May 22, 1984

[54] USE OF CARBON ADSORPTION DEACTIVATING COMPOUNDS IN IMAGE TRANSFER ELEMENTS

[75] Inventors: Kenneth C. Mattes, Rochester; Harold C. Warren, Rush, both of N.Y.

[73] Assignee: Eastman Kodak Company, Rochester, N.Y.

[21] Appl. No.: 451,586

[22] Filed: Dec. 20, 1982

[51] Int. Cl.[3] ..... G03C 1/40; G03C 5/54; G03C 1/84

[52] U.S. Cl. ..... 430/220; 430/236; 430/239; 430/517

[58] Field of Search ..... 430/218, 220, 236, 239, 430/517

[56] References Cited

U.S. PATENT DOCUMENTS

| | | | |
|---|---|---|---|
| 3,476,563 | 11/1969 | Loria | 430/553 |
| 4,353,973 | 10/1982 | Wheeler | 430/216 |
| 4,356,250 | 10/1982 | Irani et al. | 430/216 |

FOREIGN PATENT DOCUMENTS

| | | | |
|---|---|---|---|
| 2076170A | 11/1981 | United Kingdom | 430/220 |

OTHER PUBLICATIONS

Research Disclosure vol. 151, Nov. 1976, Item 15162, pp. 76–87.

*Primary Examiner*—Richard L. Schilling
*Attorney, Agent, or Firm*—Harold E. Cole

[57] ABSTRACT

Image transfer photographic elements, assemblages, processes and compositions are described which employ carbon black in an opaque layer and/or alkaline processing composition, the carbon black having a deactivating compound adsorbed thereto so that dye image-providing material can diffuse through the opaque layer and/or processing composition without any substantial adsorption thereof to the carbon black, the deactivating compound being incapable of releasing any dye moiety therefrom.

In a preferred embodiment, the deactivating compound has the following formula:

wherein:

(a) Ballast is an organic ballasting radical;

(b) Z is or is part of Y;

(c) G is $OR^1$ or $NHR^2$ wherein $R^1$ is hydrogen or a hydrolyzable moiety and $R^2$ is hydrogen or a substituted or unsubstituted alkyl group of 1 to about 22 carbon atoms;

(d) Y represents the atoms necessary to complete a benzene nucleus, a naphthalene nucleus or a 5- to 7-membered heterocyclic ring;

(e) X is a moiety which is adsorbed to the carbon black and thus retards adsorption thereto of the dye image-providing material;

(f) J is a bivalent linking group which is non-cleavable by oxidation; and (g) n is a positive integer of 1 to 2 and is 2 when G is $OR^1$ or when $R^2$ is hydrogen or an alkyl group of less than 8 carbon atoms.

Post-processing image dye diffusion is thereby lessened.

25 Claims, No Drawings

USE OF CARBON ADSORPTION DEACTIVATING COMPOUNDS IN IMAGE TRANSFER ELEMENTS

This invention relates to photography, and more particularly to photographic elements, assemblages, processes and compositions for color diffusion transfer photography employing carbon black and a particular carbon adsorption deactivating compound. Post-processing image dye diffusion is thereby lessened.

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuses to the dye image-receiving layer to form an image of the original subject.

In color transfer assemblages such as those described above, a "shut-down" mechanism is needed to stop development after a predetermined time, such as 20 to 60 seconds in some formats, or up to 3 to 10 minutes or more in other formats. Since development occurs at a high pH, it is rapidly slowed by merely lowering the pH. The use of a neutralizing layer, such as a polymeric acid, can be employed for this purpose. Such a layer will stabilize the element after silver halide development and the required diffusion of dyes has taken place. A timing layer is usually employed in conjunction with the neutralizing layer, so that the pH is not prematurely lowered, which would prematurely restrict development and dye release. The development time is thus established by the time it takes the alkaline composition to penetrate through the timing layer. As the system starts to become stabilized, alkali is depleted throughout the structure, causing silver halide development to substantially cease in response to this drop in pH. This may also cause the dye release rate to slow down. For each image generating unit, this shutoff mechanism establishes the amount of silver halide development and the related amount of dye released or formed according to the respective exposure values.

All photographic systems require good image discrimination and low $D_{min}$ values which do not change appreciably with time. In image transfer systems, however, a problem which sometimes occurs is that the $D_{min}$ (and $D_{max}$) continues to increase over a period of time. This is sometimes described in the art as "post-processing image dye density increase".

Carbon black is commonly employed in opaque layers of diffusion transfer elements, such as those described above, to provide one or two sides of a chemical "darkroom" in which silver halide development and dye diffusion is initiated. Such opaque layers may either be preformed in the photographic element or formed after processing of the element by means of an opaque processing composition which is inserted into the element. In either event, image dyes come into contact with or must pass through an opaque layer containing carbon black.

The inherent adsorptive property of carbon remains a problem. When released dye migrating through a carbon opaque layer is adsorbed on the carbon surface, low $D_{max}$ results. If this were an irreversible reaction, an increase in the amount of dye image-providing material might effectively recover the $D_{max}$. Unfortunately, however, dyes adsorbed on the carbon are subsequently released either oxidatively or nonoxidatively, thus providing a post-processing image dye density increase.

Several apparently simple means of deactivating carbon might at first appear to be practical. For example, sulfur compounds are adsorbed strongly to the surface of carbon. However, the use of sulfur compounds is not practical in photographic systems since they might severly inhibit development or cause fog. See page 80 of *Research Disclosure,* Vol. 151, November 1976, Item 15162, where there is a disclosure of the use of metallic oxides for carbon black dispersions to deactivate sulfur-containing impurities.

In U.K. Patent Application No. 2,076,170A, there is a disclosure of a forced oxidation of carbon black to modify the surface of the particles so that they absorb less color image dye and aggregate less. Some color image dye is still absorbed by the carbon using this technique, however.

In Irani and Maier U.S. Pat. No. 4,356,250, issued Oct. 26, 1982, and Wheeler U.S. Pat. No. 4,353,973, issued Oct. 12, 1982, there is a disclosure in the examples of the use of a cyan redox dye releaser (RDR) in the carbon layer. It is effective in providing a high initial $D_{max}$ since it is adsorbed efficiently to the surface of the carbon. The cyan imaging dye that subsequently migrates through this carbon layer does not compete effectively for the adsorption sites. Although this provides a high initial $D_{max}$ which is desirable, a secondary problem is created. Because the material employed is an RDR, it will release cyan dye slowly under oxidative conditions and with keeping under extreme conditions. This released dye diffuses to the mordant resulting in density increases that may be unacceptable in $D_{min}$ areas.

There is thus a need to provide an effective carbon adsorption deactivating compound for image transfer photography that does not undergo oxidative or long-term release, thus providing a more stable sensitometry.

U.S. Pat. No. 3,476,563 relates to couplers which form dyes which are included within the scope of the carbon adsorption deactivating compounds employed in our invention. There is no disclosure in that patent, however, of the use of those compounds as carbon deactivators.

A photographic element in accordance with our invention comprises a support having thereon a dye image-receiving layer, an opaque layer comprising carbon black, and at least one silver halide emulsion layer having associated therewith a dye image-providing material, and wherein the carbon black has a deactivating compound adsorbed thereto so that the dye image-providing material can diffuse through the opaque layer without any substantial adsorption thereof to the carbon black, the deactivating compound being incapable of releasing any dye moiety therefrom.

In a preferred embodiment of our invention, the deactivating compound has the following formula:

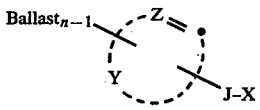

wherein:

(a) Ballast is an organic ballasting radical of such molecular size and configuration (e.g., simple organic groups or polymeric groups) as to render the compound nondiffusible in the photographic element during development by an alkaline processing composition;

(b) Z is

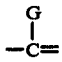

or is part of Y;

(c) G is $OR^1$ or $NHR^2$ wherein $R^1$ is hydrogen or a hydrolyzable moiety, e.g., acetyl, mono-, di-, or trichloroacetyl, perfluoroacyl, pyruvyl, alkoxyacyl, nitrobenzoyl, cyanobenzoyl, sulfonyl, sulfinyl, etc., and $R^2$ is hydrogen or a substituted or unsubstituted alkyl group of 1 to about 22 carbon atoms, such as methyl, ethyl, hydroxyethyl, propyl, butyl, sec-butyl, tert-butyl, cyclopropyl, 4-chlorobutyl, cyclobutyl, 4-nitroamyl, hexyl, cyclohexyl, octyl, decyl, octadecyl, dodecyl, sulfonamido, benzyl or phenethyl (when $R^2$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring, such as pyrazolone or pyrimidine;

(e) X is a moiety which is adsorbed to the carbon black and thus retards adsorption thereto of the dye image-providing material;

(f) J is a bivalent linking group which is noncleavable by oxidation; and (g) n is a positive integer of 1 to 2 and is 2 when G is OR′ or when $R^2$ is hydrogen or an alkyl group of less than 8 carbon atoms.

In the above formula, X may be any moiety as long as part of the deactivating compound is adsorbed to the carbon black, thereby permitting the dye image-providing material to pass through the opaque layer without any substantial adsorption thereof to the carbon black. In a preferred embodiment, X may be a dye, a dye precursor or a moiety containing a series of conjugated $\pi$ bonds.

J in the above formula can be any bivalent linking group, linking X to the rest of the compound, as long as it is not cleavable by oxidation. Such groups would include, for example, $—(CR^3R^4)_m—$, $—NR^5—$, $—NR^5—SO_2—$, $—NR^5—PO_2—$, $—NR^5—PO_3—$, $—NR^3CO—$, $—NR^3COR^5—$, —O—, $—OR^5—$, $—SR^5—$,

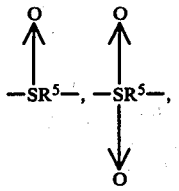

$—PO_2R^5—$ or $—PO_3R^5—$, wherein $R^3$ and $R^4$ each independently represents hydrogen, alkyl, aryl, aralkyl or alkaryl; $R^5$ is alkyl, aryl, aralkyl or alkaryl; and m is an integer of from 1 to about 16. In a preferred embodiment of our invention, J is —NHCO— or —O—.

In a preferred embodiment of our invention, the carbon adsorption deactivating compound has the formula:

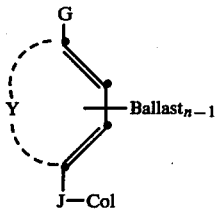

wherein Ballast, G, Y, J and n are defined as above, and Col is a dye, a dye precursor or a moiety containing a series of conjugated $\pi$ bonds.

Dye moieties useful as X or Col are well known to those skilled in the art and include dyes such as azo, azomethine, azopyrazolone, indoaniline, indophenol, anthraquinone, triarylmethane, aliazrin, merocyanine, nitro, quinoline, cyanine, indigoid, phthalocyanine, metal-complexed dyes, etc. Dye precursors useful as X or Col would include leuco dyes, oxichromic dyes, "shifted" dyes which shift hypsochromically or bathochromically when subjected to a different environment such as a change in pH, etc. Examples of such moieties are disclosed in U.S. Pat. No. 3,928,312 of Fleckenstein, the disclosure of which is hereby incorporated by reference.

As noted above, X or Col may also be a moiety containing a series of conjugated $\pi$ bonds. By this term is meant a series of alternating multiple and single bonds, such as unsaturated aliphatic chains or condensed aromatic rings, e.g., 1,3-butadiene, naphthalene, phenanthrene or pyrene.

In another preferred embodiment of our invention, G in the formula immediately above may be OH, Y represents the atoms necessary to complete a naphthalene nucleus, Col is a dye, J is $—NHCOR^5—$ or $—OR^5—$, wherein $R^5$ is alkyl, aryl, aralkyl or alkaryl, and n is 2.

Specific compounds included within the scope of our invention include the following:

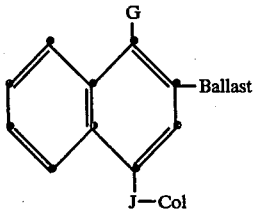

| Compound | Ballast | G | J | Col |
|---|---|---|---|---|
| 1 | Ballast 1 | —OH | —NHCOCH$_2$— 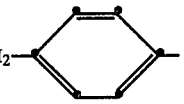 | Dye 1 |
| 2 | Ballast 2 | —OH | —O— 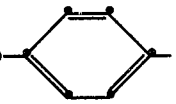 | Dye 1 |
| 3 | —CON($C_{18}H_{37}$)$_2$ | —OH | —NHCOCH$_2$— | Dye 1 |
| 4 | Ballast 1 | —OH | —NHCOCH$_2$— | Dye 1 |
| 5 | Ballast 1 | —OH | —NHCO$_2$— 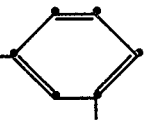 | Dye 2 |
| 6 | Ballast 1 | —OH | —NHCO— 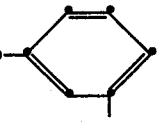 | Dye 1 |
| 7 | Ballast 2 | —OH | —O— 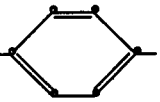 | Dye 3 |
| 8 | Ballast 2 | —OH | —O— 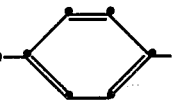 | Dye 2 |
| 9 | Ballast 2 | —NH($CH_2$)$_2$—NHSO$_2$CH$_3$ | —N(CH$_3$)—SO$_2$— | Dye 1 |
| 10 | —CON($C_{18}H_{37}$)$_2$ | —NH($CH_2$)$_2$—NHSO$_2$CH$_3$ | —N(CH$_3$)—CO— | Dye 1 |
| 11 | — | —NH$C_{15}H_{31}$ | —N(CH$_3$)—CO— | Dye 1 |
| 12 | —NHCO$C_{18}H_{37}$ | —NH($CH_2$)$_2$—NHSO$_2$CH$_3$ | —SO— 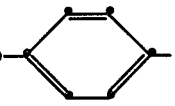 | Dye 2 |
| 13 | —NHCO$C_{18}H_{37}$ | —NHSO$_2$CH$_3$ | —CH$_2$CH$_2$— | Dye 2 |
| 14 | — | —NH$C_{15}H_{31}$ | —SO— 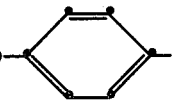 | Dye 4 |

-continued

| | | | | |
|---|---|---|---|---|
| 15 | — | $-NHC_{15}H_{31}$ | 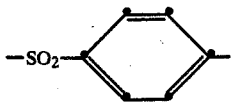 | Dye 4 |
| 16 | Ballast 1 | $-NH_2$ | $-N(CH_3)-$ | Dye 2 |
| 17 | Ballast 1 | $-OH$ | $\leftarrow CH_2 \rightarrow_6$ | Dye 2 |

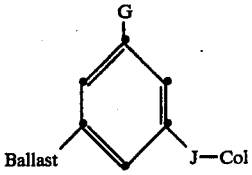

| Compound | Ballast | G | J | Col |
|---|---|---|---|---|
| 18 | $-NHSO_2C_{18}H_{37}$ | $-NHCH_2$ 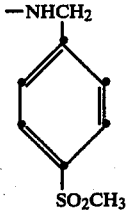 | $-\overset{CH_3}{\overset{\vert}{N}}-SO_2-$ | Dye 1 |
| 19 | $-OC_{18}H_{37}$ | $-OH$ | $-\overset{CH_3}{\overset{\vert}{N}}-SO_2-$ | Dye 1 |
| 20 | $-NHSO_2C_{18}H_{37}$ | $-OH$ | 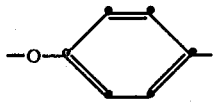 | Dye 1 |

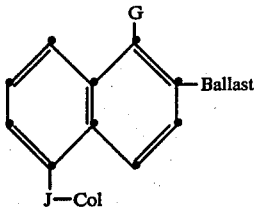

| Compound | Ballast | G | J | Col |
|---|---|---|---|---|
| 21 | Ballast 1 | $-O-\overset{O}{\overset{\Vert}{C}}-CH_3$ | $-\overset{C_6H_5}{\overset{\vert}{N}}-PO_2-$ | Dye 2 |
| 22 | Ballast 1 | $-O-\overset{O}{\overset{\Vert}{C}}-CH_3$ | $-\overset{C_2H_5}{\overset{\vert}{N}}-PO_3-$ | Dye 2 |
| 23 | $-NHCOC_{18}H_{37}$ | $-NH(CH_2)_2-NHSO_2CH_3$ | $-SCH_2-CH_2-$ | Dye 2 |

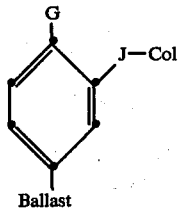

| Compound | Ballast | G | J | Col |
|---|---|---|---|---|
| 24 | Ballast 2 | $-NH(CH_2)_2-NHSO_2C_2H_5$ | $-\overset{CH_3}{\overset{\vert}{N}}-SO_2-$ | Dye 4 |
| 25 | $-CON(C_{18}H_{37})_2$ | $-OH$ | $-OC_2H_4-$ | Dye 4 |

-continued

| | | | | |
|---|---|---|---|---|
| 26 | $-CON(C_{18}H_{37})_2$ | $-OH$ | $-\overset{\overset{\displaystyle CH_3}{\vert}}{N}-SO_2-$ | Dye 4 |

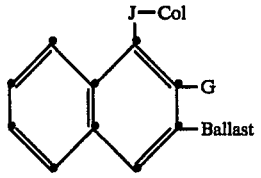

| Compound | Ballast | G | J | Col |
|---|---|---|---|---|
| 27 | $-CON(C_{18}H_{37})_2$ | $-NH(CH_2)_2-NHSO_2C_2H_5$ | $-PO_2C_2H_4-$ | Dye 4 |
| 28 | $-CON(C_{18}H_{37})_2$ | $-NH(CH_2)_2-NHSO_2C_2H_5$ | $-PO_3C_2H_4-$ | Dye 4 |

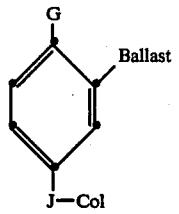

| Compound | Ballast | G | J | Col |
|---|---|---|---|---|
| 29 | Ballast 1 | $-O-\overset{\overset{\displaystyle O}{\Vert}}{C}-CH_3$ | $-CH_2CH_2-$ | Dye 1 |

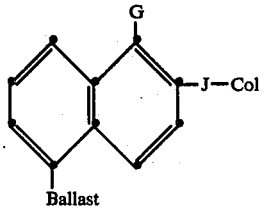

| Compound | Ballast | G | J | Col |
|---|---|---|---|---|
| 30 | Ballast 2 | $-NHCH_2CH_2OH$ | $\leftarrow CH_2 \rightarrow_6$ | Dye 1 |

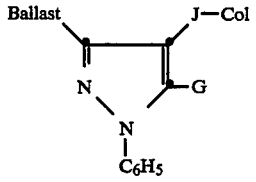

| Compound | Ballast | G | J | Col |
|---|---|---|---|---|
| 31 | $-CON(C_{18}H_{37})_2$ | $-OH$ | $-NHCOCH_2-$ 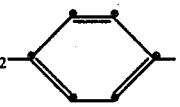 | Dye 1 |

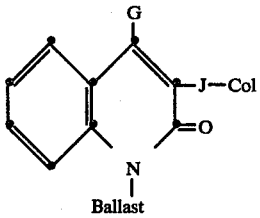

| Compound | Ballast | G | J | Col |
|---|---|---|---|---|
| 32 | $-C_{18}H_{37}$ | $-OH$ | $-NHCOCH_2-$ 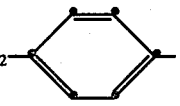 | Dye 2 |

-continued
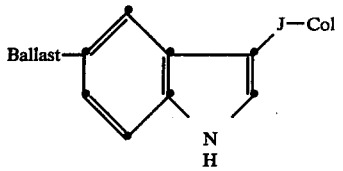
| Compound | Ballast | J | Col |
|---|---|---|---|
| 33 | $-C_{18}H_{37}$ | $-NHCOCH_2-$ 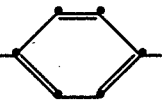 | Dye 2 |
| 34 | $-C_{18}H_{37}$ | $-SO_2-$ 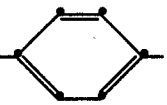 | Dye 2 |
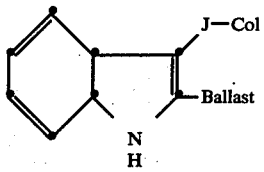
| Compound | Ballast | J | Col |
|---|---|---|---|
| 35 | $-C_{18}H_{37}$ | $-SO_2-$ 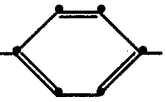 | Dye 2 |
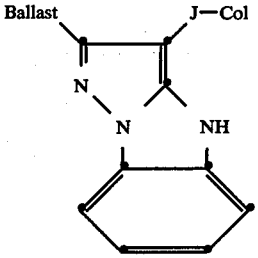
| Compound | Ballast | J | Col |
|---|---|---|---|
| 36 | $-C_{18}H_{37}$ | $-NHCOCH_2-$ 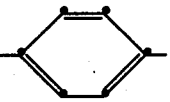 | Dye 2 |
Ballast 1 =
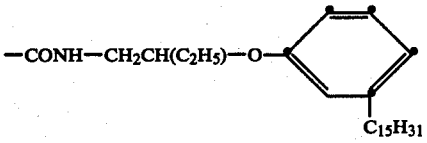
Ballast 2 =
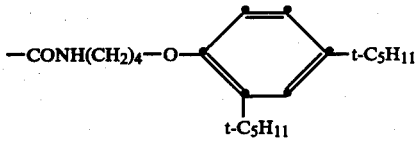

-continued

Dye 1 =

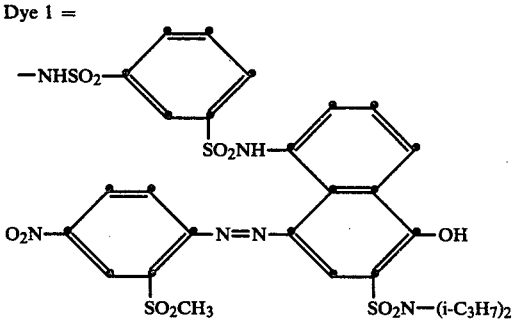

Dye 2 =

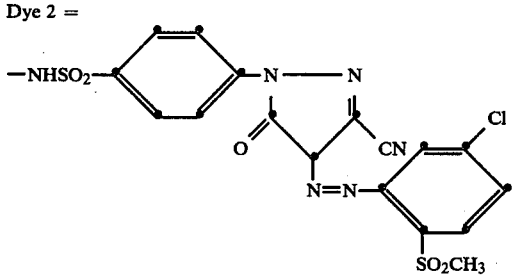

Dye 3 =

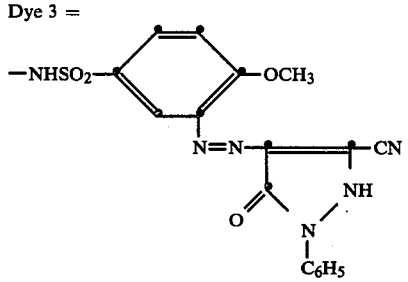

Dye 4 =

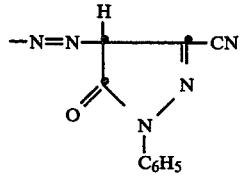

The carbon adsorption deactivating compounds described above are effective carbon adsorbers and produce good $D_{max}/D_{min}$ image discrimination that is retained after incubation or long term keeping. They can be conveniently incorporated in an opaque layer by dispersing them in an amide, phenol or ester coupler solvent. Other addenda may also be incorporated in the opaque layer including antioxidants and competers such as 2-(2-octadecyl)-5-sulfohydroquinone.

The carbon adsorption deactivating compounds described above may be employed in an opaque layer in any concentration which is effective for the intended purpose. In general, good results have been obtained at a concentration of from about 5 to about 25 mg/m$^2$ of element. When the carbon adsorption deactivating compound is employed in a processing composition, it again may be employed in any amount which is effective for the intended purpose. In general, good results have been obtained at a concentration of from about 0.5 to about 2.5 g/l of composition.

A photographic assemblage in accordance with this invention comprises:

(a) a photographic element as described above;

(b) an alkaline processing composition comprising carbon black and means containing same for discharge within the assemblage; and (c) a transparent cover sheet, and wherein either the opaque layer in the photographic element or the alkaline processing composition or both contain a carbon adsorption deactivating compound as described above.

In a preferred embodiment of the invention, the means containing the alkaline processing composition is a rupturable container or pod which is adapted to be positioned during processing of the film unit so that a compressive force applied to the container by pressure-applying members, such as would be found in a camera designed for in-camera processing, will effect a discharge of the container's contents within the film unit. In general, the processing composition employed in this invention contains the developing agent for development, although the composition could also just be an alkaline solution where the developer is incorporated in the photographic element or cover sheet, in which case the alkaline solution serves to activate the incorporated developer.

The dye image-providing material useful in this invention is either positive- or negative-working, and is either initially mobile or immobile in the photographic element during processing with an alkaline composition. Examples of initially mobile, positive-working dye image-providing materials useful in this invention are described in U.S. Pat. Nos. 2,983,606; 3,536,739; 3,705,184; 3,482,972; 2,756,142; 3,880,658 and 3,854,985. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Pat. No. 602,607. In a preferred embodiment of this invention, the dye image-providing material is a ballasted, redox-dye-releasing (RDR) compound. Such compounds are well known to those skilled in the art and are, generally speaking, compounds which will react with oxidized or unoxidized developing agent or electron transfer agent to release a dye. Such nondiffusible RDR's include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Pat. No. 2,854,946, the disclosures of which are hereby incorporated by reference.

In a preferred embodiment of this invention, positive-working quinone RDR's, are employed and the photographic element contains an incorporated reducing agent as described in U.S. Pat. No. 4,139,379, referred to above. In this embodiment, the positive-working quinone RDR compound as incorporated in a photographic element is incapable of releasing a diffusible dye. However, during photographic processing under alkaline conditions, the compound is capable of accepting at least one electron (i.e., being reduced) and thereafter releases a diffusible dye. Further details are found in U.S. Pat. No. 4,139,379, the disclosure of which is hereby incorporated by reference.

A useful format for integral negative-releaser photographic elements in which the present invention is useful is disclosed in Belgian Pat. No. 757,960. In such an embodiment, the support for the photographic element is transparent and is coated with a dye image-receiving layer, a light-reflective layer, e.g., $TiO_2$, an opaque layer comprising carbon black and the carbon absorption deactivating compound described above, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is useful is disclosed in Canadian Pat. No. 928,559. In this embodiment, the support for the photographic element is transparent and is coated with a dye image-receiving layer, a light-reflective layer, an opaque layer comprising carbon black and the carbon absorption deactivating compound described above, and the photosensitive layer or layers described above. A rupturable container, containing an alkaline processing composition, carbon black and the carbon adsorption deactivating compound described above, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

A process according to our invention for lessening the amount of post-processing image dye diffusion from a color photographic transfer image comprises:

(a) exposing a photographic element comprising a support having thereon a dye image-receiving layer, an opaque layer comprising carbon black and a carbon adsorption deactivating compound as described above, and at least one photosensitive silver halide emulsion layer having associated therewith a dye image-providing material, (b) treating the element with an alkaline processing composition in the presence of a silver halide developing agent to effect development of each of the exposed silver halide emulsion layers, and (c) diffusing an imagewise distribution of dye image-providing material which is formed as a function of development through the opaque layer to a dye image-receiving layer to provide the transfer image, the carbon adsorption deactivating compound substantially preventing any dye image-providing material from being adsorbed on the surface of the carbon black, whereby, after processing has been completed, the amount of dye diffusing to the dye image-receiving layer is substantially eliminated.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 $g/m^2$ has been found to be useful. The dye image-providing material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; or phenylenediamine compounds such as N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In our invention, dye image-providing materials can be used which produce diffusible dye images as a function of development. Either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using negative-working ballasted, redox dye-releasers. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-initiated reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsions layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agents can be employed in various interlayers of the photographic elements of the invention. Suitable materials are disclosed on page 83 of the November 1976 edition of *Research Disclosure,* the disclosure of which is hereby incorporated by reference.

Any material is useful as the dye image-receiving layer in this invention, as long as the desired function of mordanting or otherwise fixing the dye images is obtained. The particular material chosen will, of course, depend upon the dye to be mordanted. Suitable mateials are disclosed on pages 80 through 82 of the November 1976 edition of *Research Disclosure,* the disclosure of which is here incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hyroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference. The composition also contains carbon black and a deactivating compound adsorbed thereto having the following formula:

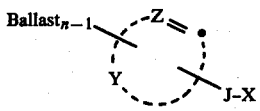

wherein:

(a) Ballast is an organic ballasting radical;

(b) Z is

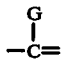

or is part of Y;

(c) G is $OR^1$ or $NHR^2$ wherein $R^1$ is hydrogen or a hydrolyzable moiety and $R^2$ is hydrogen or a substituted or unsubstituted alkyl group of 1 to about 22 carbon atoms;

(d) Y represents the atoms necessary to complete a benzene nucleus, a naphthalene nucleus or a 5- to 7-membered heterocyclic ring;

(e) X is a dye, a dye precursor or a moiety containing a series of conjugated $\pi$ bonds;

(f) J is a bivalent linking group which is non-cleavable by oxidation; and (g) n is a positive integer of 1 to 2 and is 2 when G is $OR^1$ or when $R^2$ is hydrogen or an alkyl group of less than 8 carbon atoms.

A composition of matter according to our invention comprises carbon black and a deactivating compound adsorbed thereto as described immediately above.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference. *Research Disclosure* and *Product Licensing Index* are publications of Industrial Opportunities Ltd.; Homewell, Havant; Hampshire, P09 1EF, United Kingdom.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Carbon Absorption Deactivator In Opaque Layer ($D_{max}$)

(A) A control receiving element was prepared by coating the following layers in the order recited on a transparent poly(ethylene terephthalate) film support. Quantities are parenthetically given in grams per square meter.

(1) image-receiving layer of poly(styrene-co-N-benzyl-N,N-dimethyl-N-vinylbenzylammonium chloride-co-divinylbenzene) (molar ratio 49/49/2) (2.3) and gelatin (2.3);

(2) reflecting layer of titanium dioxide (16.0) and gelatin (2.6);

(3) interlayer of gelatin (1.2) and bis(vinylsulfonyl)-methyl ether (0.02);

(4) opaque layer of carbon black (1.7), gelatin (1.2), oxidized developer scavenger 2-(2-octadecyl)-5-sulfohydroquinone potassium salt (0.02); and (5) overcoat layer of gelatin (10.8) and bis(vinylsulfonyl)methyl ether (0.12).

(B) A comparison receiving element was prepared similar to (A) except that a cyan RDR was employed in layer (4) as a carbon absorption deactivator at 22 mg/m$^2$ (as a 25 percent aqueous dispersion in N-n-butylactanilide with 1 percent Tamol® SN surfactant). The cyan RDR employed was CYAN RDR A from Example 1 of Wheeler, U.S. Pat. No. 4,353,973, issued Oct. 12, 1982:

CYAN RDR A

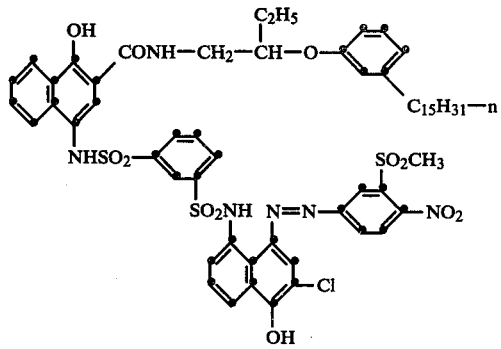

(C–F) Receiving elements in accordance with our invention were prepared similar to (A) except that compounds 1–4 above were employed in layer 4 at 22 mg/m$^2$ (as a 25 percent aqueous dispersion in N-n-butylacetanilide with 1 percent Tamol® SN surfactant).

A cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/m$^2$); and (2) a timing layer comprising 1.1 g/m$^2$ of a 1:1 physical mixture by weight of poly(acrylonitrile-co-vinylidene chloride-co-acrylic acid latex) (weight ratio of 14/80/6) and a carboxy ester lactone formed by cyclization of a vinyl acetate-maleic anhydride copolymer in the presence of 1-butanol to produce a partial butyl ester, ratio of acid:ester of 15:85; and (3) gelatin layer (3.8 g/m$^2$) hardened at one percent with bis(vinylsulfonyl)methyl ether.

A dye-containing processing composition was prepared by dissolving 40 mg of the following cyan dye in 60 ml of 1 N potassium hydroxide. To this solution, 2.1 g/l carboxymethylcellulose was added and the mixture was stirred for one hour. The structure of the cyan dye was:

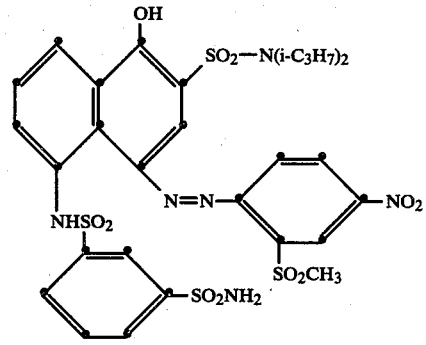

A 2 ml aliquot of the dye in the processing composition was spread and laminated between the above receivers and the cover sheet using a pair of 75 μm gap undercut rollers. After a period of one week at room temperature, 20° C., 70 percent RH, the reflection density of the transferred dye on the receiver side was read at 650 nm, the λ-max of the dye. The following results were obtained:

| Receiver | Carbon Adsorption Deactivator in Opaque Layer | 650 nm Density after 1 week at 20° C., 70% RH |
|---|---|---|
| (A) | none (control) | 0.96 |
| (B) | Cyan RDR A (comparison) | 1.14 |
| (C) | Compound 1 | 1.09 |
| (D) | Compound 2 | 1.14 |
| (E) | Compound 3 | 1.14 |
| (F) | Compound 4 | 1.08 |

Under these conditions of "ideal transfer" involving no imaging chemistry, differences in density represent differences in the matrix through which the dye diffused. The dye migrating through the carbon-only opaque layer (control receiver A) gave the lowest density indicating adsorption of some of the dye on the carbon surface. The comparison carbon adsorption deactivator, cyan RDR A, and the carbon adsorption deactivators of the invention, Compounds 1–4, showed higher density on the receiver, indicating adsorption sites on the carbon were blocked to migrating dye. The density of dye transferred was essentially equivalent to that observed in a coating without any opacifying layer.

Although the comparison carbon adsorption deactivator cyan RDR A in the receiver gave a density equivalent to the compounds according to the invention, the comparison compound produced other problems as will be shown in the subsequent examples.

EXAMPLE 2

Oxidative Release of Dye From Comparison Carbon Adsorption Deactivator ($D_{min}$)

Receiving elements according to Example 1 were prepared.

A light-sensitive element was prepared consisting of a 0.8 μm monodispersed silver bromo-iodide emulsion (1.0 g Ag/m$^2$) in 1.0 g/m$^2$ gelatin and hardened with 2 percent bis(vinylsulfonyl)methyl ether.

A processing composition was prepared containing:

| | |
|---|---|
| Potassium hydroxide | 47 g/l |
| 4-hydroxymethyl-4-methyl-1-p-tolyl-3-pyrazolidinone | 2 g/l |
| carboxymethylcellulose | 57 g/l |

An aliquot of the processing composition was spread and laminated between the receivers and a portion of the light-sensitive element using a pair of 75 μm gap undercut rollers. This and all subsequent operations were carried out in room light to insure fogging of the emulsion. After a period of 24 hours at room temperature, the reflection $D_{min}$ density was read at 650 nm. The above procedure was repeated for a second test. The following results were obtained:

| Receiver | Carbon Adsorption Deactivator in Opaque Layer | 650 nm Density after 24 hours, R.T. Test 1 | Test 2 |
|---|---|---|---|
| (A) | none (control) | 0.13 | 0.15 |
| (B) | Cyan RDR A (comparison) | 0.48 | 0.49 |
| (C) | Compound 1 | 0.23 | — |
| (D) | Compound 2 | 0.17 | — |
| (E) | Compound 3 | 0.15 | — |
| (F) | Compound 4 | — | 0.18 |

The control receiver (A) with no carbon adsorption deactivator produced the lowest density. Although satisfactory from this standpoint, there is a problem in obtaining adequate dye transfer when no carbon deactivator is employed, as Example 1 has shown.

Receiver (B) with the comparison carbon adsorption deactivating compound, Cyan RDR A, produced a very high $D_{min}$. This is due to the fogged silver halide being reduced to metallic silver, the 3-pyrazolidinone electron transfer agent being converted to its oxidized form, which in turn caused dye to be released from the Cyan RDR A.

In receivers C–F, no oxidative release occurred and a low $D_{min}$ was obtained. Since those receivers also produced a high $D_{max}$ (Example 1), they gave the best image discrimination of the compounds tested.

EXAMPLE 3

Incubation Tests

Receiving elements according to Example 1 were prepared using Compounds 1–6.

Cover sheets similar to those of Example 1 were prepared except that timing layer (2) coverage was 5.4 g/m$^2$.

A processing composition of 57 g carboxymethylcellulose and 47 g potassium hydroxide per liter of solution was prepared.

An aliquot of the processing composition was spread and laminated between the receiver and the cover sheet using a pair of 75 μm undercut rollers. After a period of 24 hours at 60° C., 70 percent RH, the reflection density was read at 650 nm. The above procedure was repeated for a second test. The following results were obtained.

| Receiver | Carbon Adsorption Deactivator in Opaque Layer | 650 nm Density after 24 hours at 60° C., 70% RH Test 1 | Test 2 |
|---|---|---|---|
| (A) | none (control) | 0.11 | 0.13 |
| (B) | Cyan RDR A (comparison) | 0.30 | 0.29 |
| (C) | Compound 1 | 0.16 | — |
| (D) | Compound 2 | 0.13 | — |
| (E) | Compound 3 | 0.19 | — |
| (F) | Compound 4 | — | 0.14 |
| (G) | Compound 5 | — | 0.13 |
| (H) | Compound 6 | — | 0.13 |

The above results parallel the findings of Example 2. The receiver (B) with the comparison carbon adsorption deactivating compound, cyan RDR A, produced a high stain, indicating dye release. The receivers (C) to (H) employing a carbon adsorption deactivating compound in accordance with our invention, however, had lower stain values than the comparison receiver.

EXAMPLE 4

Lessening of Post-Process Dye Diffusion in a Multicolor Element

Cover sheets similar to those of Example 3 were prepared.

(A) A control integral imaging-receiver element was prepared by coating the following layers in the order recited on a transparent poly(ethylene terephthalate) film support. Quantities are parenthetically given in grams per square meter, unless otherwise stated.

(1) image-receiving layer of a poly(styrene-co-N-benzyl-N,N-dimethyl-N-vinylbenzyl)ammonium sulfateco-divinylbenzene) (molar ratio 49/49/2) (2.3) and gelatin (2.3);

(2) reflecting layer of titanium dioxide (16.2) and gelatin (2.6);

(3) opaque layer of carbon black (1.9), gelatin (1.2), and oxidized developer scavenger 2-(2-octadecyl)-5-sulfohydroquinone potassium salt (0.02);

(4) cyan dye-providing layer of gelatin (0.44) and cyan RDR B (0.32) dispersed in N-n-butylacetanilide, RDR/solvent ratio 1:2;

(5) interlayer of gelatin (0.54);

(6) red-sensitive, direct-positive silver bromide emulsion (1.1 silver), gelatin (1.2), Nucleating Agent A (45 mg/Ag mole), 2-(2-octadecyl)-5-sulfohydroquinone potassium salt (0.14), Nucleating Agent B (1.6 mg/Ag mole) and titanium dioxide (0.81);

(7) interlayer of gelatin (1.2) and 2,5-di-sec-dodecylhydroquinone (1.2);

(8) magenta dye-providing layer of magenta RDR C (0.43) dispersed in diethyllauramide, RDR/solvent ratio 1:2 and gelatin (0.65);

(9) interlayer of gelatin (0.65);

(10) green-sensitive, direct-positive silver bromide emulsion (0.92 silver), gelatin (0.76), Nucleating Agent A (11.0 mg/Ag mole), Nucleating Agent C (1.2 mg/Ag mole), 2-(2-octadecyl)-5-sulfohydroquinone potassium salt (0.034) and titanium dioxide (0.22);

(11) interlayer of green-sensitive negative silver bromide emulsion (0.05 silver), gelatin (1.3) and 2,5-di-sec-dodecylhydroquinone (1.2);

(12) yellow dye-providing layer of yellow RDR D (0.32) dispersed in di-n-butyl phthalate, RDR/solvent ratio 1:2, yellow RDR E (0.24) dispersed in di-n-butyl phthalate, RDR/solvent ratio 1:2, gelatin (1.2) and hardener bis(vinylsulfonyl)methane (0.006);

(13) blue-sensitive, direct-positive silver bromide emulsion (0.92 silver), gelatin (0.91), Nucleating Agent A (31 mg/Ag mole), Nucleating Agent C (1.1 mg/Ag mole), 2-(2-octadecyl)-5-sulfohydroquinone potassium salt (0.034), t-butylhydroquinone monoacetate (0.016) and titanium dioxide (0.27); and

(14) overcoat layer of gelatin (0.89) and 2,5-di-sec-dodecylhydroquinone (0.10).

The direct-positive emulsions are approximately 0.8$\mu$ monodispersed, octahedral, internal image silver bromide emulsions, as described in U.S. Pat. No. 3,923,513.

(B) A comparison integral imaging-receiver element was prepared similar to (A) except that opaque layer (3) contained CYAN RDR A (Example 1) (0.022) dispersed in N-n-butylacetanilide, RDR/solvent ratio of 1:2, as a carbon adsorption deactivator.

(C) An integral imaging-receiver element according to the invention was prepared similar to (B) except that Compound 8 was employed instead of CYAN RDR A.

CYAN RDR B

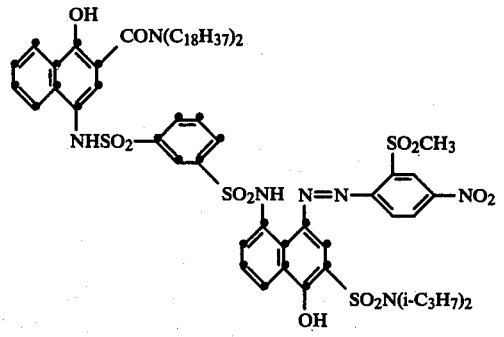

MAGENTA RDR C

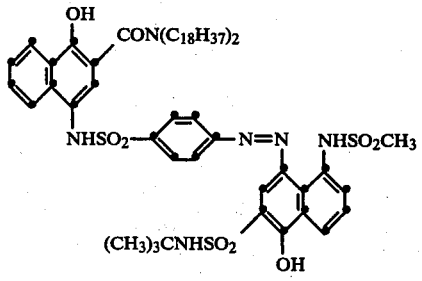

YELLOW RDR D

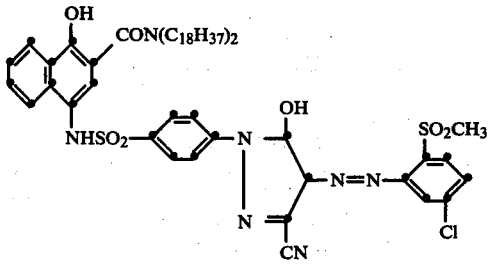

YELLOW RDR E

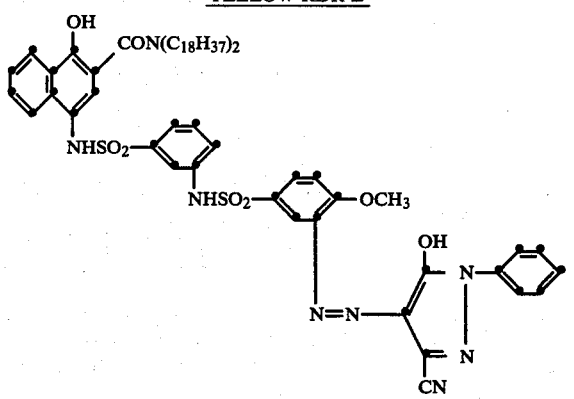

Nucleating Agent A

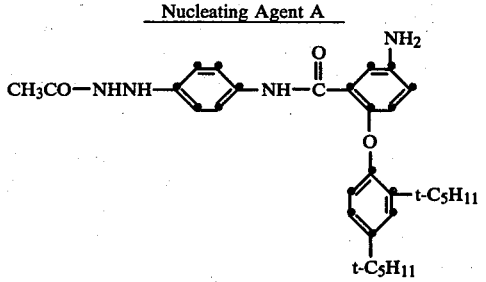

Nucleating Agent B

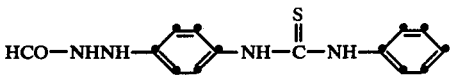

Nucleating Agent C

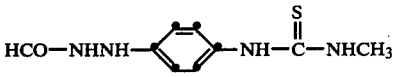

The imaging-receiver elements were exposed in a sensitometer through a graduated density test object to yield a neutral at a Status A density of 1.0. The elements were then processed at 21° C. by rupturing a pod containing the viscous processing composition described below between the imaging-receiver elements and the cover sheets described above, by using a pair of juxtaposed rollers to provide a processing gap of about 65 μm.

The processing composition was as follows:

| | |
|---|---|
| 52.2 g | Potassium hydroxide |
| 12 g | 4-Methyl-4-hydroxymethyl-1-p-tolyl-3-pyrazolidinone |
| 1.5 g | 1,4-cyclohexanedimethanol |
| 4 g | 5-methylbenzotriazole |
| 1 g | potassium sulfite |
| 6.4 g | Tamol SN ® dispersant |
| 10 g | potassium fluoride |
| 46 g | carboxymethylcellulose |
| 192 g | carbon |
| | water to 1 liter. |

After a period of not less than one hour, the "fresh" sensitometry of the density curves were obtained by computer integration of the individual step Status A densities. The laminated unit was then incubated for two weeks at 32° C., 70% RH. The samples were read again and the change in red density from an original density of 1.0 was tabulated. The $D_{min}$ change upon incubation was also determined. The following results were obtained:

| IIR | Carbon Adsorption Deactivator in Opaque Layer 3 | Status A Red Density Change Upon Incubation ΔD at D = 1.0 | $\Delta D_{min}$ |
|---|---|---|---|
| (A) Control | none | +0.11 | +0.03 |
| (B) Comparison | CYAN RDR A | +0.05 | +0.03 |
| (C) Invention | Compound 8 | +0.03 | 0 |

The above results indicate that a much more stable sensitometry (less red density increase at a density of 1.0 and less $D_{min}$ increase) was obtained using the carbon adsorption deactivator of the invention.

The invention has been described in detail with particular reference to preferred embodiments thereof, but it will be understood that variations and modifications can be effected within the spirit and scope of the invention.

What is claimed is:

1. In a photographic element comprising a support having thereon a dye image-receiving layer, an opaque layer comprising carbon black, and at least one silver halide emulsion layer having associated therewith a dye image-providing material, the improvement wherein said carbon black has a ballasted deactivating compound adsorbed thereto in such an amount so that said dye image-providing material can diffuse through said opaque layer without any substantial adsorption thereof to said carbon black, said deactivating compound being incapable of releasing any dye moiety therefrom during photographic processing of said element to form a dye image.

2. The photographic element of claim 1 wherein said deactivating compound has the following formula:

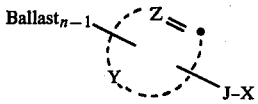

wherein:

(a) Ballast is an organic ballasting radical of such molecular size and configuration as to render said compound nondiffusible in said photographic element during development by an alkaline processing composition;

(b) Z is

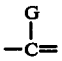

or is part of Y;

(c) G is $OR^1$ or $NHR^2$ wherein $R^1$ is hydrogen or a hydrolyzable moiety and $R^2$ is hydrogen or a substituted or unsubstituted alkyl group of 1 to about 22 carbon atoms;

(d) Y represents the atoms necessary to complete a benzene nucleus, a naphthalene nucleus or a 5- to 7-membered heterocyclic ring;

(e) X is a moiety which is adsorbed to said carbon black and thus retards adsorption thereto of said dye image-providing material;

(f) J is a bivalent linking group which is non-cleavable by oxidation; and (g) n is a positive integer of 1 to 2 and is 2 when G is $OR^1$ or when $R^2$ is hydrogen or an alkyl group of less than 8 carbon atoms.

3. The element of claim 2 wherein X is a dye, a dye precursor or a moiety containing a series of conjugated π bonds.

4. The element of claim 2 wherein said deactivating compound has the formula:

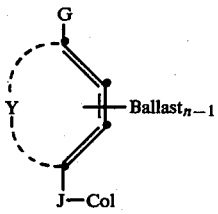

wherein Ballast, G, Y, J and n are defined as in claim 2, and Col is a dye, a dye precursor or a moiety containing a series of conjugated π bonds.

5. The element of claim 4 wherein J is $-(CR^3R^4)_m-$, $-NR^5-$, $-NR^5-SO_2-$, $-NR^5-PO_2-$, $-NR^5-PO_3-$, $-NR^3CO-$, $-NR^3COR^5-$, $-O-$, $-OR^5-$, $-SR^5-$,

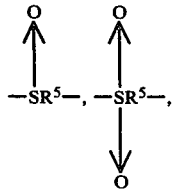

$-PO_2R^5-$ or $-PO_3R^5-$, wherein $R^3$ and $R^4$ each independently represents hydrogen, alkyl, aryl, aralkyl or alkaryl; $R^5$ is alkyl, aryl, aralkyl or alkaryl; and m is an integer of from 1 to about 16.

6. The element of claim 4 wherein G is OH, Y represents the atoms necessary to complete a naphthalene nucleus, Col is a dye, J is $-NHCOR^5-$ or $-OR^5-$, wherein $R^5$ is alkyl, aryl, aralkyl or alkaryl and n is 2.

7. The element of claim 4 wherein said dye image-providing material is a redox dye-releaser and said deactivating compound is present at a concentration of from about 5 to about 25 mg/m$^2$ of element.

8. The element of claim 4 which comprises said support having thereon said dye image-receiving layer, said opaque layer, a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

9. In a photographic assemblage comprising:

(a) a photographic element comprising a support having thereon a dye image-receiving layer, an opaque layer comprising carbon black and at least one photosensitive silver halide emulsion layer having associated therewith a dye image-providing material;

(b) an alkaline processing composition comprising carbon black and means containing same for discharge within said assemblage; and (c) a transparent cover sheet;

the improvement wherein said carbon black in said opaque layer or said alkaline processing composition or both has a ballasted deactivating compound adsorbed thereto in such an amount so that said dye image-providing material can diffuse through said opaque layer and/or said alkaline processing composition without any substantial adsorption thereof to said carbon black, said deactivating compound being incapable of releasing any dye moiety therefrom during photographic processing of said element to form a dye image.

10. The assemblage of claim 9 wherein said deactivating compound has the following formula:

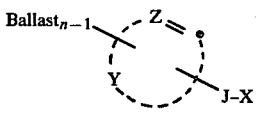

wherein:

(a) Ballast is an organic ballasting radical of such molecular size and configuration as to render said compound nondiffusible in said photographic element during development by an alkaline processing composition;

(b) Z is

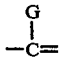

or is part of Y;

(c) G is $OR^1$ or $NHR^2$ wherein $R^1$ is hydrogen or a hydrolyzable moiety and $R^2$ is hydrogen or a substituted or unsubstituted alkyl group of 1 to about 22 carbon atoms;

(d) Y represents the atoms necessary to complete a benzene nucleus, a naphthalene nucleus or a 5- to 7-membered heterocyclic ring;

(e) X is a moiety which is adsorbed to said carbon black and thus retards adsorption thereto of said dye image-providing material;

(f) J is a bivalent linking group which is noncleavable by oxidation; and (g) n is a positive integer of 1 to 2 and is 2 when G is $OR^1$ or when $R^2$ is hydrogen or an alkyl group of less than 8 carbon atoms.

11. The assemblage of claim 10 wherein X is a dye, a dye precursor or a moiety containing a series of conjugated $\pi$ bonds.

12. The assemblage of claim 10 wherein said deactivating compound has the formula:

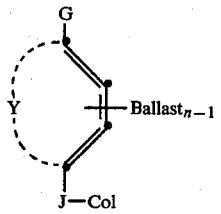

wherein Ballast, G, Y, J and n are defined as in claim 10, and Col is a dye, a dye precursor or a moiety containing a series of conjugated $\pi$ bonds.

13. The assemblage of claim 12 wherein said J is $-(CR^3R^4)_m-$, $-NR^5-$, $-NR^5-SO_2-$, $-NR^5-PO_2-$, $-NR^5-PO_3-$, $-NR^3CO-$, $-NR^3COR^5-$, $-O-$, $-OR^5-$, $-SR^5-$,

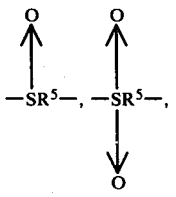

$-PO_2R^5-$ or $-PO_3R^5-$, wherein $R^3$ and $R^4$ each independently represents hydrogen, alkyl, aryl, aralkyl or alkaryl; $R^5$ is alkyl, aryl, aralkyl or alkaryl; and m is an integer of from 1 to about 16.

14. The assemblage of claim 12 wherein G is OH, Y represents the atoms necessary to complete a naphthalene nucleus, Col is a dye, J is $-NHCOR^5-$ or $-OR^5-$, wherein $R^5$ is alkyl, aryl, aralkyl or alkaryl, and n is 2.

15. The assemblage of claim 12 wherein said dye image-providing material is a redox dye-releaser and said deactivating compound is present in said opaque layer.

16. The assemblage of claim 12 wherein said opaque layer contains said deactivating compound and is present at a concentration of from about 5 to about 25 mg/m$^2$ of element.

17. The assemblage of claim 12 wherein said cover sheet is coated with, in sequence, a neutralizing layer and a timing layer.

18. The assemblage of claim 17 wherein said discharging means is a rupturable container containing said alkaline processing composition comprising carbon black and said deactivating compound, said container being so positioned during processing of said assemblage that a compressive force applied to said container will effect a discharge of the container's contents between said transparent cover sheet and the layer outermost from said support.

19. The assemblage of claim 12 wherein said photographic element comprises said support having thereon said dye image-receiving layer, said opaque layer, a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

20. In an integral photographic assemblage comprising (a) a photographic element comprising a transparent support having thereon the following layers in sequence: a dye image-receiving layer; an alkaline solution-permeable, light-reflective layer; an alkaline solution-permeable, opaque layer comprising carbon black; a red-sensitive, direct-positive silver halide emulsion layer having a ballasted redox cyan dye-releaser associated therewith; a green-sensitive, direct-positive silver halide emulsion layer having a ballasted redox magenta dye-releaser associated therewith; and a blue-sensitive, direct-positive silver halide emulsion layer having a ballasted redox yellow dye-releaser associated therewith;

(b) a transparent cover sheet superposed over said blue-sensitive silver halide emulsion layer and comprising a transparent support coated with, in sequence, a neutralizing layer and a timing layer; and (c) a rupturable container containing an alkaline processing composition and carbon black, said container being so positioned during processing of said assemblage that a compressive force applied to said container will effect a discharge of the container's contents between said transparent cover sheet and said blue-sensitive silver halide emulsion layer;

said assemblage containing a silver halide developing agent, the improvement wherein said carbon black in said opaque layer or said alkaline processing composition or both has a ballasted deactivating compound adsorbed thereto in such an amount so that the dye which is released from said dye releaser can diffuse through said opaque layer and/or said alkaline processing composition without any substantial adsorption thereof to said carbon black, said deactivating compound being incapable of releasing any dye moiety therefrom during photographic processing of said element to form a dye image.

21. The assemblage of claim 20 wherein said deactivating compound has the following formula:

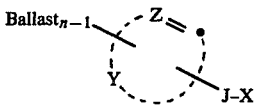

wherein:

(a) Ballast is an organic ballasting radical of such molecular size and configuration as to render said compound nondiffusible in said photographic element during development by an alkaline processing composition;

(b) Z is

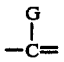

or is part of Y;

(c) G is OR$^1$ or NHR$^2$ wherein R$^1$ is hydrogen or a hydrolyzable moiety and R$^2$ is hydrogen or a substituted or unsubstituted alkyl group of 1 to about 22 carbon atoms;

(d) Y represents the atoms necessary to complete a benzene nucleus, a naphthalene nucleus or a 5- to 7-membered heterocyclic ring;

(e) X is a moiety which is adsorbed to said carbon black and thus retards adsorption thereto of the dye which is released from said dye releaser;

(f) J is a bivalent linking group which is non-cleavable by oxidation; and (g) n is a positive integer of 1 to 2 and is 2 when G is OR$^1$ or when R$^2$ is hydrogen or an alkyl group of less than 8 carbon atoms.

22. The assemblage of claim 21 wherein said compound has the formula

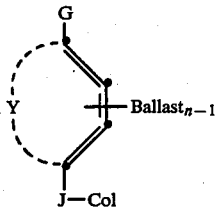

wherein Ballast, G, Y, J and n are defined as in claim 21, and Col is a dye, a dye precursor or a moiety containing a series of conjugated $\pi$ bonds.

23. A process for lessening the amount of post-processing image dye diffusion from a color photographic transfer image comprising:

(a) exposing a photographic element comprising a support having thereon a dye image-receiving layer, an opaque layer comprising carbon black and at least one photosensitive silver halide emulsion layer having associated therewith a dye image-providing material, (b) treating said element with an alkaline processing composition in the presence of a silver halide developing agent to effect development of each of said exposed silver halide emulsion layers, and (c) diffusing an imagewise distribution of dye image-providing material which is formed as a function of development through said opaque layer to a dye image-receiving layer to provide said transfer image, said carbon black having a ballasted deactivating compound adsorbed thereto in such an amount so that said dye image-providing material can diffuse through said opaque layer without any substantial adsorption thereof to said carbon black, said deactivating compound being incapable of releasing any dye moiety therefrom during photographic processing of said element to form said transfer image, whereby, after processing has been completed, the amount of dye diffusing to said dye image-receiving layer is substantially eliminated.

24. The process of claim 23 wherein said said deactivating compound has the following formula:

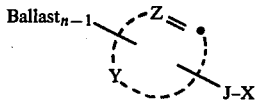

wherein:

(a) Ballast is an organic ballasting radical of such molecular size and configuration as to render said compound nondiffusible in said photographic element during development by an alkaline processing composition;

(b) Z is

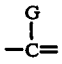

or is part of Y;

(c) G is $OR^1$ or $NHR^2$ wherein $R^1$ is hydrogen or a hydrolyzable moiety and $R^2$ is hydrogen or a substituted or unsubstituted alkyl group of 1 to about 22 carbon atoms;

(d) Y represents the atoms necessary to complete a benzene nucleus, a naphthalene nucleus or a 5- to 7-membered heterocyclic ring;

(e) X is a moiety which is adsorbed to said carbon black and thus retards adsorption thereto of said dye image-providing material;

(f) J is a bivalent linking group which is non-cleavable by oxidation; and (g) n is a positive integer of 1 to 2 and is 2 when G is $OR^1$ or when $R^2$ is hydrogen or an alkyl group of less than 8 carbon atoms.

25. The process of claim 24 wherein said compound has the formula:

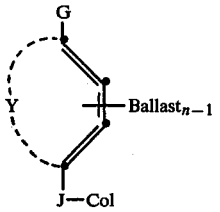

wherein Ballast, G, Y, J and n are defined as in claim 24, and Col is a dye, a dye precursor or a moiety containing a series of conjugated $\pi$ bonds.

* * * * *